US005672857A

United States Patent [19]

Frost et al.

[11] Patent Number: 5,672,857

[45] Date of Patent: Sep. 30, 1997

[54] SWITCH ACTUATING MECHANISM FOR TWO SEQUENTIALLY ACTIVATED SWITCHES

[75] Inventors: Richard L. Frost; Edgar C. Kolb; James S. Robinson, all of Freeport, Ill.

[73] Assignee: Honeywell Inc., Minneapolis, Minn.

[21] Appl. No.: 639,355

[22] Filed: Apr. 26, 1996

[51] Int. Cl.[6] ..... H01H 3/06

[52] U.S. Cl. ..... 200/61.81; 200/61.78

[58] Field of Search ..... 200/50.32, 50.35, 200/50.37, 61.62, 61.76, 61.78, 61.79, 61.81, 61.82

[56] References Cited

U.S. PATENT DOCUMENTS

| | | | |
|---|---|---|---|
| 4,528,430 | 7/1985 | Lewandowski et al. . | |
| 4,529,859 | 7/1985 | Lewandowski . | |
| 4,547,634 | 10/1985 | Leger . | |
| 4,618,747 | 10/1986 | Schaffeler | 200/67 PK |
| 4,687,889 | 8/1987 | Leger . | |
| 4,703,147 | 10/1987 | Happ et al. . | |
| 4,717,794 | 1/1988 | Paul et al. . | |
| 5,079,395 | 1/1992 | Barnard et al. | 200/557 |
| 5,517,165 | 5/1996 | Cook | 335/18 |

*Primary Examiner*—Matthew V. Nguyen

*Attorney, Agent, or Firm*—William D. Lanyi; John G. Shudy, Jr.

[57] ABSTRACT

A switch actuation mechanism is provided with a support structure that is shaped to hold two switches. Each switch is associated with a pivotable member that is rotatably attached to the support structure. The pivotable member can be moved into either a rest position or an actuating position. When in the rest position, an actuating surface of the pivotable member is placed in contact with a plunger of the associated switch. A resilient member, such as a spring, is used to urge the pivotable members into their rest positions. If an actuator, such as a plunger or latch, is move into contact with a protrusion extending from the pivotable member, the pivotable member is rotated clockwise and the actuating surface is moved out of contact with the plunger. This deactuates the switch. The two switches are arranged to provide a sequential deactuation as two actuators are moved into contact with their respective protrusions extending from the pivotable members.

17 Claims, 4 Drawing Sheets

SWITCH ACTUATING MECHANISM FOR TWO SEQUENTIALLY ACTIVATED SWITCHES

BACKGROUND OF THE INVENTION

1. Field of the Invention

The present invention is generally related to a switch actuation mechanism and, more particularly, to a mechanism that allows two switches to be actuated and deactuated without subjecting the switch plungers to excessive force.

2. Description of the Prior Art

In certain applications, it is necessary to provide a means for disposing two switches at preselected locations in such a way that they are actuated sequentially by two actuators. One example of this type of application is in the door interlock for an appliance, such as a microwave oven. In certain microwave oven door applications, the actuators comprise a plunger and a latch which are attached to the door and which move into contact with switch plungers when the door is closed. In many applications of this type, the closure of the door provides significant actuating force against the switch plungers. This significant force can damage the switch over an extended period of usage.

U.S. Pat. No. 4,717,794, which issued to Paul et al on Jan. 5, 1988, discloses an interlock switch with a switch mechanism for controlling circuits such as in a microwave oven. It includes a housing with a removable cover and a latch member and plunger member movable between a first position wherein the microwave oven door is closed and a second position, with the primary microwave circuits closed in said first position. Contact arms which all extend in one direction toward the latch member and plunger, a catch for holding the door closed, a slide for operating the primary switch means, and a cam operated by the plunger for operating switch means, all are slideably removable from the housing in a lateral direction. The switch sequence is arranged so that one set of primary contacts open after the other and the structure is arranged so that if the slide for operating the switch means sticks, the movement of the plunger to the second position will insure that the circuit containing the primary switch means is opened.

U.S. Pat. No. 4,528,430, which issued to Lewandowski et al on Jul. 9, 1985, describes an electrical appliance interlock switch with a force efficient actuator. The interlock switch is used with an electrical appliance such as a microwave oven. The interlock switch comprises a housing having a plurality of conductive switch elements operated by an actuator. At least two of the conductive switch elements are biased in opposite directions, thereby reducing the force that would otherwise be needed to operate the actuator.

U.S. Pat. No. 4,529,859, which issued to Lewandowski on Jul. 16, 1985 discloses an electrical interlock switch. The interlock switch is used with an electrical appliance, such as a microwave oven. The interlock switch includes a cantilevered common switch element and two other switch elements mounted on opposite sides of the common switch elements. When the appliance door is closed, the common switch element makes contact with the switch elements on one side and breaks contact with the switch elements on the other side.

U.S. Pat. No. 4,547,634, which issued to Leger on Oct. 15, 1985, describes an electrical appliance interlock switch with am improved buss. The interlock switch is used with an electrical appliance such as a microwave oven. The interlock switch has a housing having an interior front wall, and a plurality of conductive switch elements. A pair of barriers define a pair of gaps with the interior front wall for mounting a buss, comprising a first segment, formed integrally with one of the conductive switch elements and a second segment formed integrally with another one of the conductive switch elements.

U.S. Pat. No. 4,687,889, which issued to Leger on Aug. 18, 1987, discloses an electrical appliance interlock switch with an improved isolation means. The interlock switch is used with an electrical appliance such as a microwave oven. The interlock switch has a housing in which a plurality of switch elements are mounted. The housing also contains movable and stationary barriers which isolate selected switch elements from others so that broken off pieces from some switch elements will not come into contact with other switch elements.

U.S. Pat. No. 4,703,147, which issued to Happ et al on Oct. 27, 1987, describes a probe actuated switch that comprises a plurality of electrical contact blades and a first and second actuator for engagement with a first and second probe. The actuators are slideably mounted and positioned to engage selected ones of the contact blades. Each actuator defines a rest position and is biased to that rest position by selected contact blades. First and second probe guides are aligned for engagement with the first and second probes. Each guide is adapted to guide a respective probe into engagement with a respective actuator. A latch mechanism is positioned to releasably latch the first actuator in its rest position. As the probes are inserted into the respective prove guides, they are guided into engagement with the actuators. The second actuator is thereupon moved from its rest position to alter the electrical connections of selected ones of the plurality of contacts. The first actuator is held in its rest position until the first probe is fully inserted. The first actuator is then released by the latch and is rapidly moved from its rest position to alter the electrical connections of selected other ones of the plurality of contacts. When the probes are removed from the probe guides, the actuator is returned to the respective initial rest positions and the contact blades returned to the respective initial electrical connections.

SUMMARY OF THE INVENTION

A switch made in accordance with the preferred embodiment of the present invention comprises a support structure and a first switch attached to the support structure. The first switch has a first actuating plunger. When the first plunger is depressed, the first switch is actuated. The mechanism further comprises a first pivotable member rotatably attached to the support structure and movable between a first rest position and a first actuating position. The first pivotable member has a first actuating surface which is movable into force transmitting contact with the first actuating plunger to actuate the first switch when the first pivotable member is in the rest position. The first pivotable member also has a first protrusion extending from it. The mechanism of the present invention further comprises a first resilient member disposed in contact with the first pivotable member to urge the first pivotable member to the first rest position. The first pivotable member is movable into the first actuating position to deactuate the first switch in response to movement of a first actuator into contact with the first protrusion.

In applications where two switches are required, the switch actuation mechanism of the present invention further comprises a second switch that is attached to the support structure. The second switch has a second actuating plunger.

A second pivotable member is rotatably attached to the support structure and movable between a second rest position and a second actuating position. The second pivotable member has a second actuating surface which is movable into force transmitting contact with a second actuating plunger to actuate the second switch when the second pivotable member is in said rest position. The second pivotable member has a second protrusion extending from it. A second resilient member is disposed in contact with the second pivotable member to urge the second pivotable member to the second rest position. The second pivotable member is movable into the second actuating position to deactuate the second switch in response to movement of a second actuator into contact with the second protrusion.

In a typical application of the present invention, the support structure is rigidly attached to a stationary structure. The stationary structure can be an appliance, such as a microwave oven. The first and second actuators are rigidly attached to a movable structure and the movable structure is movable relative to the stationary structure. In a typical application of the present invention, the movable structure is the door of the microwave oven. The first and second actuators are movable into contact with the first and second protrusions, respectively, in response to movement of the movable structure toward the stationary structure. In certain applications of the present invention, the second actuator is pivotable relative to the movable structure.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
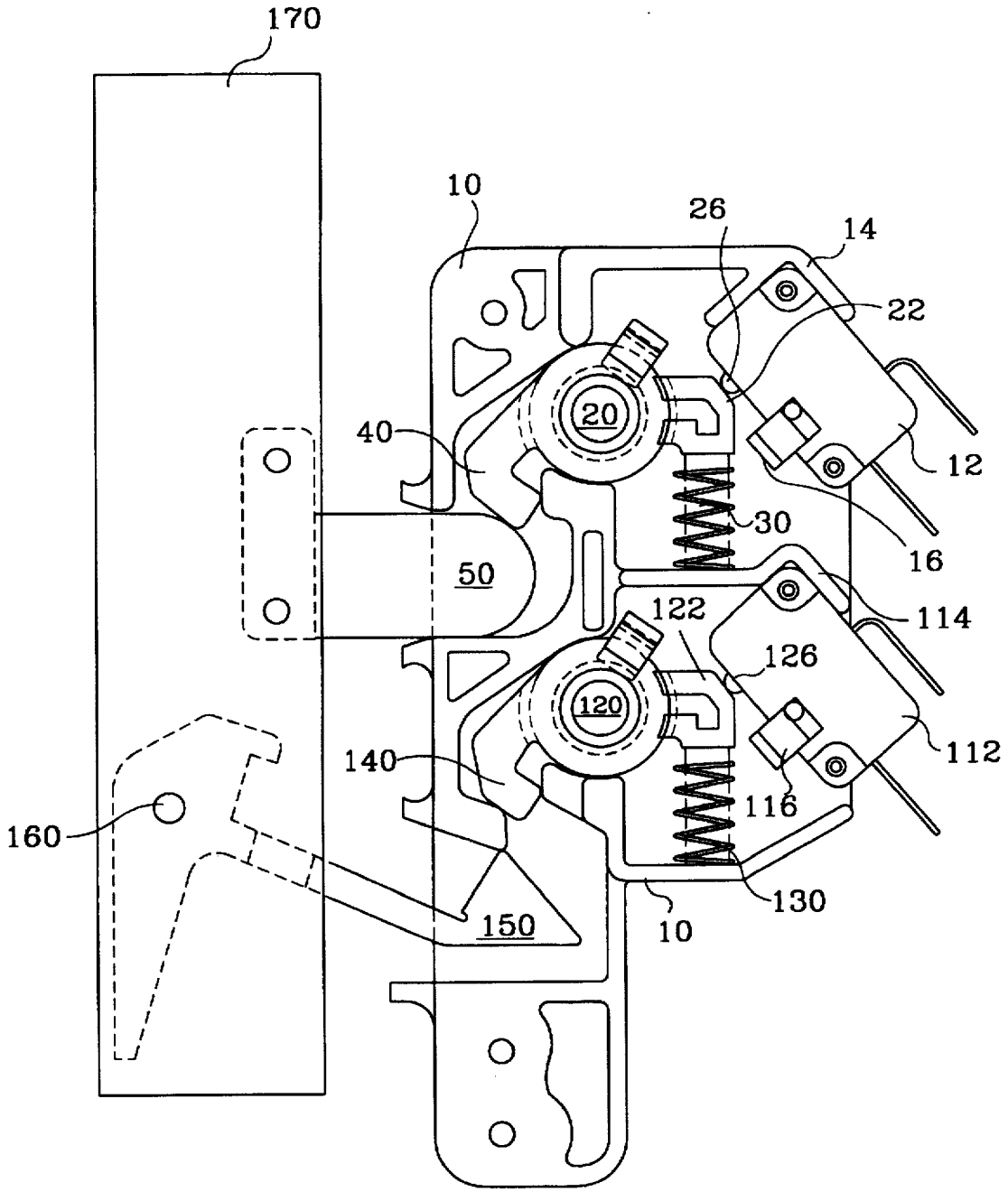
FIG. 1 shows the present invention before closure of a related door.

Throughout the Description of the Preferred Embodiment, like components will be identified by like reference numerals. The prior art described above is hereby explicitly incorporated by reference in this application. Since all of the United States Patents described above are well known to those skilled in the art, the basic operation of microwave ovens and the interlocking nature of the circuits in the microwave ovens will not be described in detail herein. Instead, the following description of the preferred embodiment of the present invention will describe its physical structure and the means by which the present invention allows an economical switch actuation mechanism to be manufactured in such a way that potentially destructive forces are not directly applicable to the plunger of the switch in such a way that damage can be caused to the switch and actuation mechanism.

Because of the operation of the present invention, it is necessary to define certain terms before describing its operation in detail. With regard to the individual switches, which are identified by reference numerals 12 and 112, the switches shall be described as being actuated when their respective plungers, 26 and 126, are depressed into the switch housings. This action will be described as the switch being actuated regardless whether the switch is normally opened or normally closed. It is recognized that, according to this terminology, a switch may be actuated in order to open a circuit in which the switch is connected. Similarly, the switches will be described as being deactuated when their plungers extend to their fullest position from the switch housings. This terminology will be used whether or not the deactuation causes an associated electrical circuit to be connected or disconnected. In addition, this terminology will be used whether the switches are normally opened or normally closed. As will be described in greater detail below, the pivotable members, 20 and 120, have a rest position and an actuating position. In the terminology of this description, the rest position is the position of the pivotable members when no external force is acting against them. The resilient member, 30 and 130, urge the pivotable members into their rest positions. When the pivotable members are in their rest positions, the associated switches are actuated because their plungers are depressed into their housings. If the pivotable members are acted upon by an external force, they are rotated in a clockwise direction toward their actuating positions. When in these actuating positions, the respective switches are deactuated because their plungers are allowed to extend from their housings. The pivotable members are actuated by the insertion of actuators, 50 and 150, into guides that cause the actuators to move into contact with the protrusions of the two pivotable members. With this terminology in mind, the overall mechanical system is actuated by the closure of a door which causes the actuators to move into contact with the protrusions of the pivotable members. This contact rotates the pivotable members from their rest positions to the actuating positions. When in their actuating positions, the pivotable members release the plungers of the switches and deactuate them.

In FIG. 1, a support structure 10 is shaped to receive basic premanufactured switches in such a way that the switches can be rigidly attached to the support structure. For example, a first switch 12 is located on pins through its mounting holes and is held in place on the support structure 10 by the shape of the corner portion 14, the pins, and a deformable holding member 16 which allows the first switch 10 to be held in place in contact with the support structure 12, but easily removable if the switch must be replaced. A first pivotable member 20 is rotatable attached to the support structure 10 and is movable between a first rest position and a first actuating position. In FIG. 1, the first pivotable member 20 is in its rest position. The first pivotable member 20 has a first actuating surface 22. In FIG. 1, the first actuating surface 22 is a surface of an extension that is formed as part of the first pivotable member 20. However, it should be understood that in alternate embodiments of the present invention, the first actuating surface can be a cam surface of a generally circular pivotable member or a lever that is pivotable about a center of rotation attached to the support structure 10. When the first pivotable member 20 is in its rest position, the first actuating surface 22 is in force transmitting relation with a plunger 26. The depression of the plunger 26 relative to the housing of the first switch 12 actuates the first switch 12. A first resilient member 30, which can be a spring as shown, is placed in contact between a portion of the support structure 10 and the first pivotable member 20. The first resilient member 30 urges the first pivotable member 20 to its rest position as shown in FIG. 1.

Therefore, the first resilient member 30 urges the first pivotable member into the rest position and causes the first switch 12 to be actuated unless some other force is exerted against the first pivotable member to move it from its rest position to its actuating position.

In FIG. 1, a first protrusion 40 is shown attached to the first pivotable member 20. When a force is exerted against the first protrusion 40, the first pivotable member can be rotated about its center of rotation from its rest position to its actuating position, thus moving the actuating surface 22 out of force transmitting contact with the plunger 26. If the force exerted against the first protrusion 40 is sufficient to overcome the force exerted by the first resilient member 30, the first pivotable member will rotate and the plunger 26 will move out of the housing of the first switch 12 and the first switch 12 will be deactuated. One means for causing the first pivotable member to move from its rest position to its actuating position is the insertion of a first actuator 50 into contact with the first protrusion 40. If the first actuator 50 moves into the guide formed in the support structure 10, and moves into contact with the first protrusion 40, it will cause a clockwise rotation of the first pivotable member 20. This clockwise rotation will cause the first actuating surface 22 to move away from the first plunger 26. The first resilient member 30 will be compressed and the first switch 12 will be deactuated. The first actuator 50 can be a plunger such as that described in U.S. Pat. No. 4,717,794 or various other components. When the first actuator 50 is removed from its guide slot formed in the support structure 10, in a direction toward the left in FIG. 1 relative to the support structure 10, the force of the first resilient member 30 will cause the first pivotable member 20 to rotate in a counterclockwise direction. This rotation will move the first actuating surface 22 to move into contact with the first plunger 26 and actuate the first switch 12.

Figure 2:
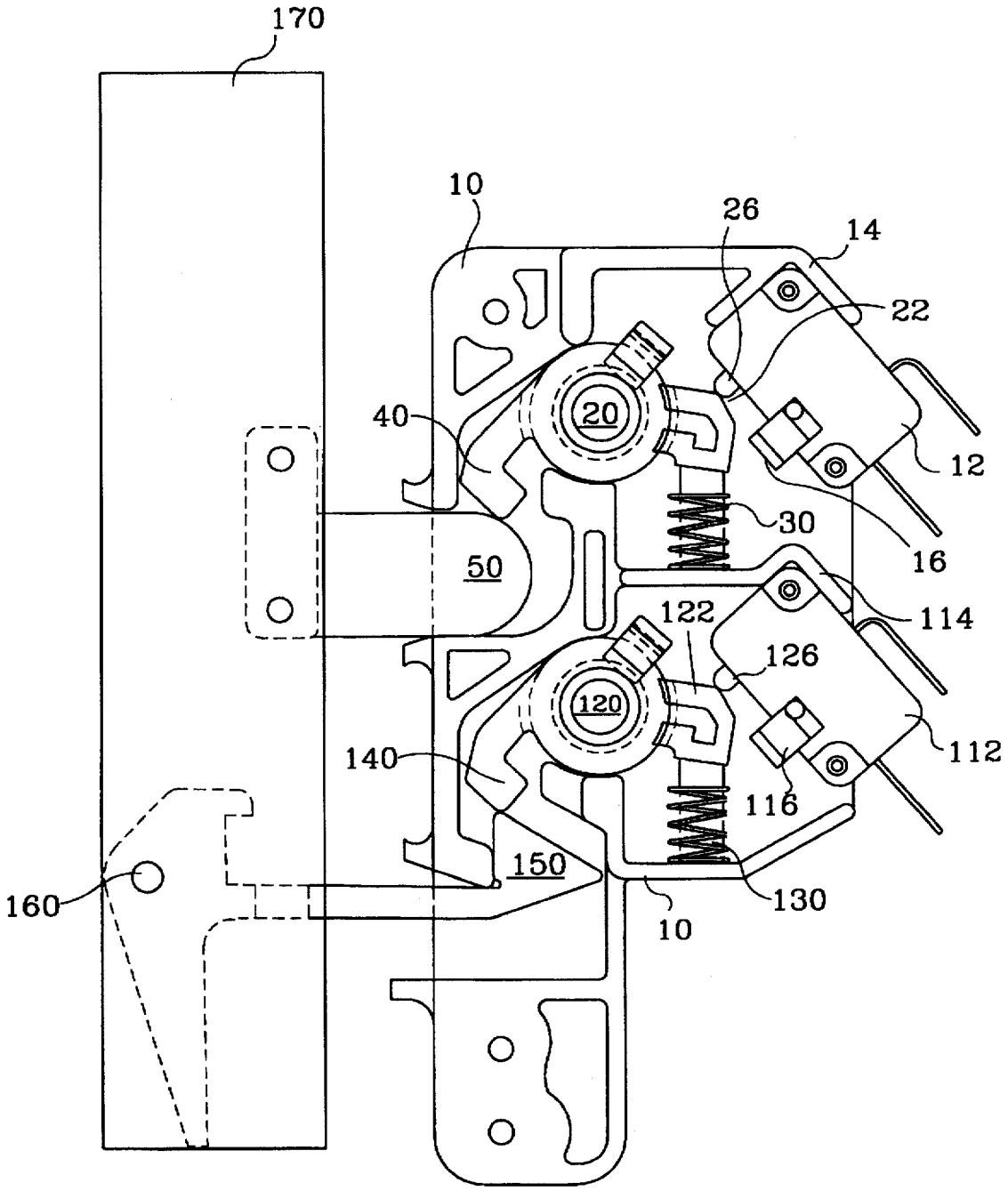
FIG. 2 shows the present invention following the closure of a related door.

Throughout the Description of the Preferred Embodiment, it will be described as being operable in conjunction with two or more switches. However, it should be understood that the mechanism described above can be advantageously used even if a single switch is actuated. The same advantage can be achieved with a single switch. In other words, the present invention reduces the forces exerted on a plunger of a switch even though the primary actuating member may be moved into its actuating position with considerable force. In order to accomplish this advantage, the present invention applies the possibly extreme force of an actuator to rotate a device that removes a much smaller force that is actuating a switch. That force, exerted by the resilient member 30 and the actuating surface 22 is moved away from the plunger and the switch is deactuated when the high actuating force of an external actuator 50 is moved into position. These advantages can be realized even if they are applied to a single switch. FIGS. 1 and 2 will be described in terms of two switches that are illustrated in those Figures. Additional switches can also be used in the same type of fixture and support structure. The addition of third and fourth switches will be described below in conjunction with FIGS. 4 and 5. Furthermore, although not shown specifically in FIGS. 1 and 2, the support structure 10 is provided with pins that extend away from the support structure and are shaped to be received in the mounting holes of the switches, 12 and 112. These cylindrical posts fit into the mounting holes of the switches and assure that the switches are placed in their proper positions. The mounting posts, in combination with the corner structures, 14 and 114, and the deformable fingers, 16 and 116, align the switches in their proper positions and retain them their until manually removed.

With continued reference to FIG. 1, it can be seen that the support structure 10 is shaped to hold two or more switches. A second switch 112 is shown held in place between a shaped corner 114 and a deformable extension 116. The second pivotable member 120 is also provided with a second actuating surface 122 that can move into contact with a second plunger 126 of the second switch 112. The second pivotable member is urged to its rest position by the second resilient member 130. A second protrusion 140 extends from the second pivotable member 120 similar to the manner described above. When a second actuator 150 moves into contact with the second protrusion 140, the second pivotable member 120 is rotated about its centerline in a clockwise direction and the second actuating surface 122 is moved out of force transmitting contact with the second plunger 126. This movement deactuates the second switch 112. The second actuator 150 can be a latch as shown and, in certain embodiments, the latch can be pivotable about a center of rotation 160.

In many applications, such as in interlock mechanisms, the first and second pivotable members are arranged with respect to their respective switches so that movement of the first and second actuators, 50 and 150, into their actuating positions will cause the first switch 12 to be deactuated before the second switch 112 is deactuated. This is done for reasons that are well known to those skilled in the art and relate to the safety interlock features of the overall mechanism and its related circuits. In a typical application of the present invention, the support structure 10 would be attached to a stationary device, such as a microwave oven. The first and second actuators, 50 and 150, would typically be attached to a movable structure 170, such as the door of a microwave oven. The illustration in FIG. 1 shows the positions of the components prior to movement of the first and second actuators, 50 and 150, into the required positions in which they cause the first and second pivotable members to move from their rest positions to their actuating positions. Both the first and second pivotable members in FIG. 1 are shown in their rest positions with their actuating surfaces, 22 and 122, being disposed in force transmitting relation with their respective plungers. The position represented in FIG. 1 would occur prior to the closure of the door of a microwave oven.

FIG. 2 shows the same mechanism illustrated in FIG. 1, but after the first and second actuators, 50 and 150, have moved into their required positions necessary to cause the first and second pivotable members to move from their rest positions to their actuating positions. For example, the first actuator 50 has moved into contact with first protrusion 40 to cause the first pivotable member 20 to rotate in a clockwise direction against the resistance of the first resilient member 30. As can be seen, the first resilient member 30 is compressed because of this rotation of the first pivotable member 20 and the first actuating surface 22 is moved out of force transmitting contact with the first plunger 26. This permits the first plunger 26 to move out of its depressed position and, as a result, the first switch 12 is deactuated.

As described above, the first switch 12 and the first pivotable member 20 are both held in position by pins and deformable fingers. For example, the deformable finger 16 allows the first switch 12 to be disposed in position by distorting the finger and placing the first switch 12 in the position shown in FIG. 2. Then the finger would be allowed to spring back to its natural position and retain the first switch 12 in its attached position relative to the support structure 10.

With continued reference to FIG. 2, it can also be seen that the second actuator 150 is in its required position to contact the second protrusion 150 and cause the second pivotable member 120 to rotate clockwise about its center of rotation. This clockwise rotation of the second pivotable member 120 causes the second resilient member 130 to be compressed and moves the second actuating surface 122 out of force transmitting contact with the second plunger 126. This results in the second switch 112 being deactuated. If either or both of the actuators, 50 and 150, move out of their positions shown in FIG. 2, the associated switch would be actuated by the natural action of its associated resilient member causing its associated pivotable member to rotate in a counterclockwise direction and move the associated actuating surface into force transmitting contact with the associated plunger.

With reference to FIGS. 1 and 2, several advantages of the present invention can be recognized. First, in comparison to the complicated structures described above in the United States Patents that are incorporated by reference in this description, the present invention allows premanufactured basic switches to be used. These switches, which can be the type of switches that are available in commercial quantities and identified as V7-1E29D9C2, V7-1E39D8 and V3-2921-D9 by the MICRO SWITCH division of Honeywell Incorporated. These commercially available switches can also be easily replaced in the event of a malfunction or switch failure. The switches can also be manufactured separately and independently from the manufacture of the remaining components attached to the support structure 10. In FIGS. 1 and 2, it can be seen that the pivotable members, 20 and 120, are also held in position by deformable fingers that can be moved out of their natural positions to permit the pivotable members to be dropped into place around shafts extending from the support structure 10. The shafts each serve as a pivot or axle around which the pivotable members can rotate in the manner described above. After the pivotable members are placed in their proper position, the deformable fingers can be allowed to snap back into their natural positions to retain the pivotable members in their proper operating location. Another important advantage of the present invention is that the actuations by the first and second actuators, 50 and 150, do not directly actuate the switches themselves. Considerable forces are exerted when the first and second actuators are moved into their positions as shown in FIG. 2. These considerable forces, if applied directly to the plungers of the switches, would rapidly deteriorate the switches and require their frequent replacement. Instead of this disadvantageous arrangement, the present invention actually uses the resilient members, 30 and 130, to actuate the switches. The insertion of the actuators, 50 and 150, into their actuating positions merely counteracts the forces provided by the first and second resilient members and gently removes the first and second actuating surfaces, 22 and 122, from contact with their respective plungers, 26 and 126. This actuation does not exert any harmful forces against the switches. The only forces that the plungers, 26 and 126, must withstand during the normal operation of the present invention in the force provided by the first and second resilient members, 30 and 130. This type of structure and mechanism will therefore increase the useful life time of the switches.

The structure of the mechanism shown in FIGS. 1 and 2 is significantly easier to manufacture than the much more complex structures described above in the description of the prior art. The support structure 10 is a molded plastic housing that is shaped to have all of the necessary configurations, such as the corners, 14 and 114, the fingers, 16 and 116, and the fingers that retain the first and second pivotable members in position. In addition, the support structure 10 is shaped to have a pair of rods that act as the axles and centers of rotation for the first and second pivotable members, 20 and 120. The assembly of the support structure includes the placement of the first and second pivotable members into their proper operating locations and the insertions of the first and second resilient members, 30 and 130, which can be simple coil springs as shown. The first and second switches are quickly located on the pins and snapped into position as shown. Compared to the complex structures described above in conjunction with the cited prior art patents, the present invention provides a much more economical support structure that is simpler and less expensive than the prior art mechanisms. In addition, easy replacement of the first and second switches is provided. Most importantly, the extreme actuating forces provided by the first and second actuators, 50 and 150, are not permitted to act directly against the first and second switches. Instead, the high forces provided by the first and second actuators are used to operate against the first and second pivotable members and, as a result, they are not transmitted directly to the plungers of the switches. Instead, these extreme forces are used to operate against the resilient members and simply deactuate their respective switches.

Figure 5:
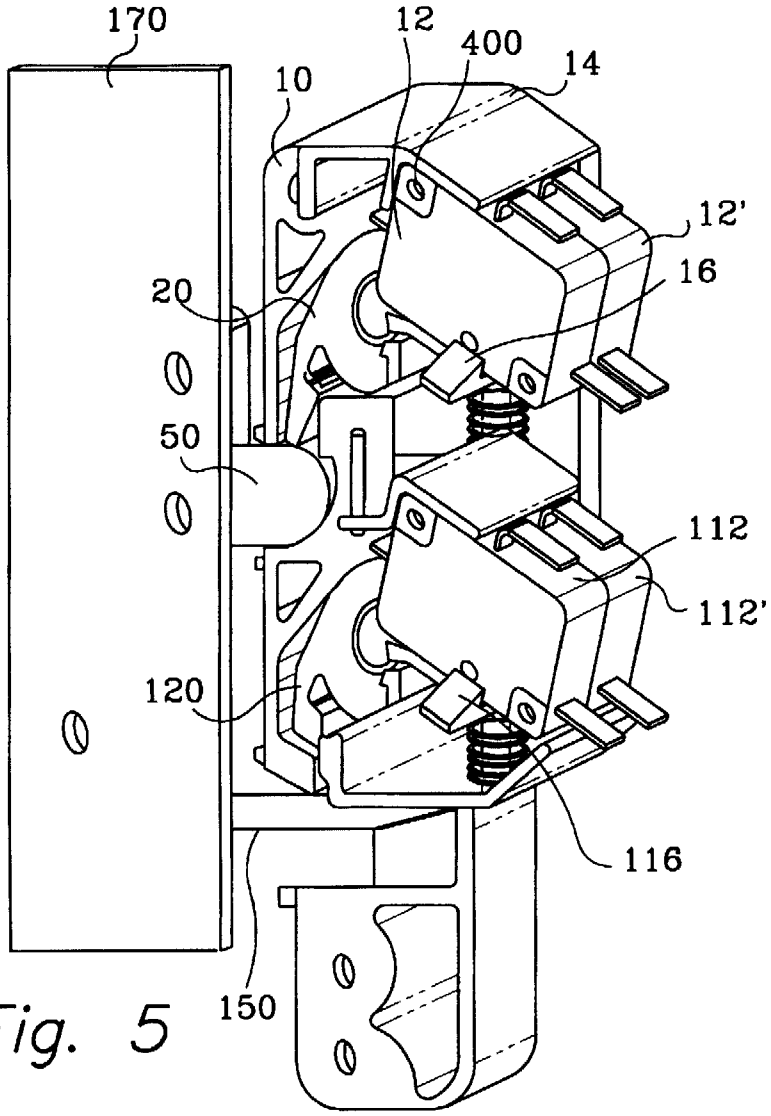
FIGS. 4 and 5 show perspective views of the present invention adapted for use with three and four basic switches, respectively.
Figure 4:
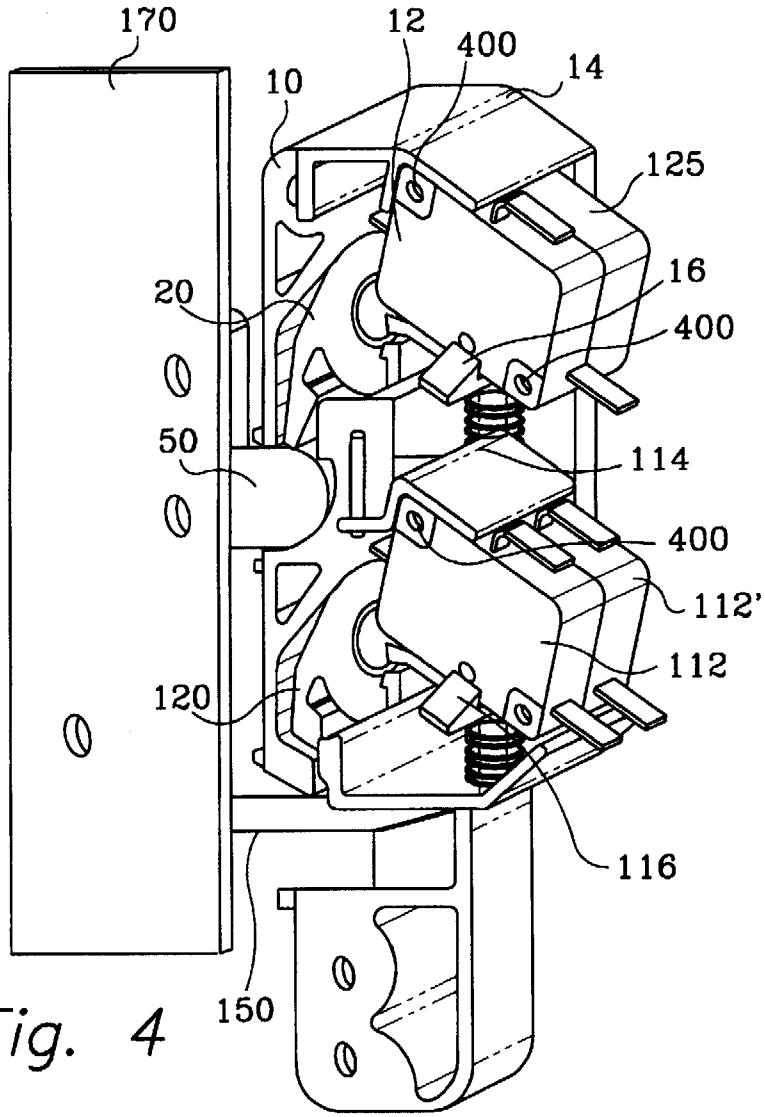

FIGS. 4 and 5 shows perspective views of two different applications of the present invention. The perspective view of FIG. 4 shows that more than one switch can be aligned at either of the two positions described above in conjunction with FIGS. 1 and 2. This stacking of switches is permitted by the present invention. The alignment pins 400, or posts, extend through the mounting holes of the switches and assure that the switches are placed at the proper position relative to the support structure 10. In FIG. 4, switch 12 is accompanied by a spacer 12S in order to place the first switch 12 at its appropriate position. The second switch 112 is associated with another switch 112'. Switches 112 and 112' are both located on the same two alignment pins 400 which extend through their mounting holes. Movement of the pivotable member 120 actuates or deactuates the two switches, 112 and 112', during a single rotation from its rest position to its actuating position, or vice versa. This does not necessarily mean that the two associated switches, 112 and 112' must be actuated simultaneously with each other. In fact, in many applications of the present invention, it is desirable that the switches be actuated with a slight delay relative to each other. For example, it might be desirable to actuate switch 112 before switch 112'. This can be accomplished in two ways. The actuating surface of the pivotable member 120 can be provided with a step that causes the actuating surface associated with the plunger of switch 112 to be depressed slightly in advance of the movement of the plunger associated with switch 112'. Alternatively, switches 112 and 112' can be manufactured in such a way that the plungers are of different lengths within the housings of the basic switches. If this is done, the cam actuating surface of the pivotable member 120 can be uniform across its width and the sequential actuation of the two switches, 112 and 112', will be accomplished through the internal mechanisms of the switches themselves. These alternative characteristics of the present invention do not limit its operation. It is adaptable to many different alternative applications of this type.

Comparing FIGS. 4 and 5, it can be seen that the spacer 12S is replaced in FIG. 5 by a switch 12'. In a configuration such as that illustrated in FIG. 5, the switches associated with the pivotable member 20 can be actuated or deactuated prior to the similar action with regard to the two switches associated with the pivotable member 120. Likewise, switch 12 can be actuated or deactuated prior to or following the actuation or deactuation of switch 12'. In other words, all four switches in FIG. 5 can be actuated or deactuated at different times, depending on the requirements of the application. The sequential operation of switches can be accomplished in two different ways as described above. If the two switches are associated with the same pivotable member, 20 or 120, the sequence can be dictated by either a step formed in the actuating cam surface of the pivotable member or, alternatively, by manufacturing the basic switches, 12 and 12', to have differently shaped plungers within their housings. Either of these two procedures will cause a sequential and nonsimultaneous actuation or deactuation of the two switches. With regard to switches that are associated with different pivotable members, 20 and 120, the physical positions of the axes of rotation of the pivotable members can be selected to cause this sequence characteristic. In addition, the switches themselves can be mounted at slightly different distances from the pivotable members. In addition, the shape of the actuating cam surfaces of the pivotable members can be selected to cause this sequential operation of two switches, such as switch 12 and switch 112.

Although the present invention is provided with many different types of possible alterations to advantageously adjust the operation of the switches, it should be understood that the selection of any particular set of operating characteristics does not limit the present invention. Whether it incorporates one switch or four switches, the basic operation of the pivotable member and its advantageous results are the same. In addition, whether the plurality of switches are actuated simultaneously or in sequence does not limit the present invention. Furthermore, it should be realized that minor alterations in the structure of the components shown in FIGS. 1, 2, 4 and 5 could easily adapt it to actuate larger numbers of switches arranged in combinations of two, three or more and at more than two actuation stations associated with individual pivotable members.

Figure 3:
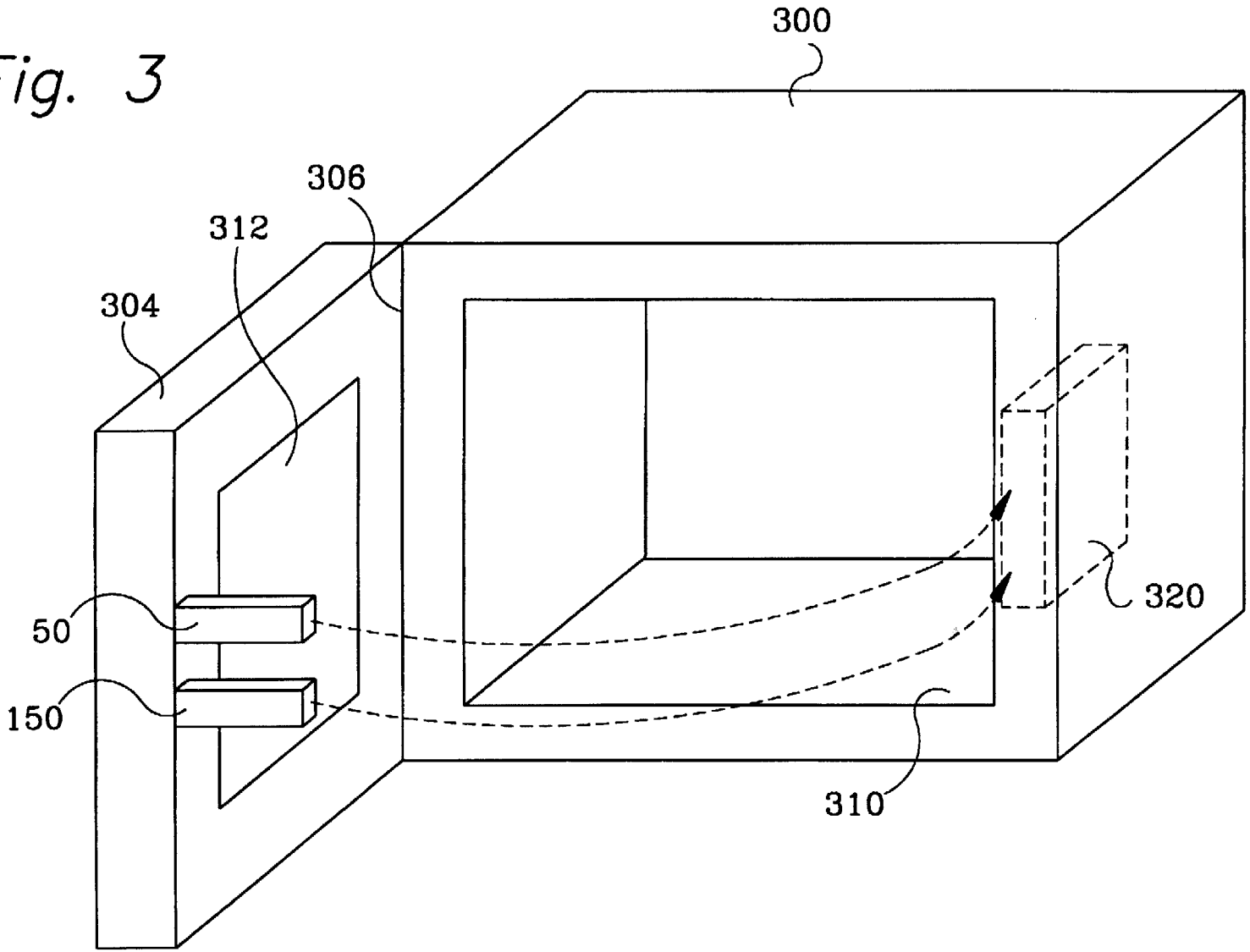
FIG. 3 shows the relative positions of the present invention, a microwave oven and a door of a microwave oven.

Although the present invention can be used in many different applications, it is particularly suitable for use in association with a microwave oven. FIG. 3 shows a microwave oven 300 with a door 304 that is movable with respect to the microwave oven 300. This movement is provided by a hinge 306. The microwave oven has an internal cavity 310 in which food or other objects can be placed. A window 312 is typically provided in the door 304. The switch actuation mechanism 320 of the present invention is disposed within the body of the microwave oven 300 in the location represented by dashed lines in FIG. 3. The first and second actuators, 50 and 150, are shown in a highly schematic representation in FIG. 3. When the door 304 is moved relative to the microwave oven 300 by rotating it about its hinge 306, the first and second actuators, 50 and 150, move in the directions represented by the dashed arrows in FIG. 3 and eventually into contact with the switch actuation mechanism portion 320 that is attached to the stationary microwave oven 300. Typically, the support structure 10, which is described above in conjunction with FIGS. 1 and 2, is provided with actuator guides that assist and guide the insertion of the first and second actuators into their respective positions relative to the support structure 10.

As can easily be understood by one skilled in the art, a typical application of the present invention would include a first switch 12 that is normally opened and a second switch 112 which is normally closed. Since the two switches are actuated when their respective pivotable members are in their rest positions and when they are rotated in a counterclockwise direction by the normal action of the resilient members, insertion of the actuators into contact with the protrusions will cause the circuit associated with the first switch to be opened because the first switch has a natural deactuated state of being normally opened. Similarly, when the second pivotable member is rotated to its actuating position and the second actuating surface is moved out of contact with the second plunger, the second switch will be closed because it is deactuated and its normal state, as a normally closed switch, is closed.

Although the present invention has been described with particular specificity and illustrated to show one preferred embodiment of the present invention, it should be understood that alternative embodiments are within its scope.

The embodiments of the invention in which an exclusive property or right is claimed are defined as follows:

1. A switch actuation mechanism, comprising:

a support structure, said support structure being rigidly attached to a stationary structure;

a first switch attached to said support structure, said first switch having a first actuating plunger;

a first pivotable member rotatably attached to said support structure and movable between a first rest position and a first actuating position, said first pivotable member having a first actuating surface which is movable into force transmitting contact with said first actuating plunger to actuate said first switch when said first pivotable member is in said first rest position, said first pivotable member having a first protrusion;

a first resilient member disposed in contact with said first pivotable member to urge said first pivotable member to said first rest position, said first pivotable member being movable into said first actuating position to deactuate said first switch in response to movement of a first actuator into contact with said first protrusion;

a second switch attached to said support structure, said second switch having a second actuating plunger;

a second pivotable member rotatably attached to said support structure and movable between a second rest position and a second actuating position, said second pivotable member having a second actuating surface which is movable into force transmitting contact with said second actuating plunger to actuate said second switch when said second pivotable member is in said second rest position, said second pivotable member having a second protrusion; and a second resilient member disposed in contact with said second pivotable member to urge said second pivotable member to said second rest position, said second pivotable member being movable into said second actuating position to deactuate said second switch in response to movement of a second actuator into contact with said second protrusion.

2. The mechanism of claim 1, wherein:

said first and second actuators are rigidly attached to a movable structure, said movable structure being movable relative to said stationary structure, said first and second actuators being movable into contact with said first and second protrusions, respectively, in response to movement of said movable structure toward said stationary structure.

3. The mechanism of claim 2, wherein:

said second actuator is pivotable relative to said movable structure.

4. The mechanism of claim 1, wherein:

said stationary structure is a microwave oven and said movable structure is a door of said microwave oven.

5. The mechanism of claim 2, wherein:

said first switch is a normally open switch and said second switch is a normally closed switch.

6. A switch actuation mechanism, comprising:

a support structure;

a first switch attached to said support structure, said first switch having a first actuating plunger;

a first pivotable member rotatably attached to said support structure and movable between a first rest position and a first actuating position, said first pivotable member having a first actuating surface which is movable into force transmitting contact with said first actuating plunger to actuate said first switch when said first pivotable member is in said first rest position, said first pivotable member having a first protrusion;

a first resilient member disposed in contact with said first pivotable member to urge said first pivotable member to said first rest position, said first pivotable member being movable into said first actuating position to deactuate said first switch in response to movement of a first actuator into contact with said first protrusion;

a second switch attached to said support structure, said second switch having a second actuating plunger;

a second pivotable member rotatably attached to said support structure and movable between a second rest position and a second actuating position, said second pivotable member having a second actuating surface which is movable into force transmitting contact with said second actuating plunger to actuate said second switch when said second pivotable member is in said second rest position, said second pivotable member having a second protrusion; and a second resilient member disposed in contact with said second pivotable member to urge said second pivotable member to said second rest position, said second pivotable member being movable into said second actuating position to deactuate said second switch in response to movement of a second actuator into contact with said second protrusion.

7. The mechanism of claim 6, wherein:

said support structure is rigidly attached to a stationary structure.

8. The mechanism of claim 7, wherein:

said first and second actuators are rigidly attached to a movable structure, said movable structure being movable relative to said stationary structure, said first and second actuators being movable into contact with said first and second protrusions, respectively, in response to movement of said movable structure toward said stationary structure.

9. The mechanism of claim 8, wherein:

said second actuator is pivotable relative to said movable structure.

10. The mechanism of claim 6, wherein:

said stationary structure is a microwave oven and said movable structure is a door of said microwave oven.

11. The mechanism of claim 6, wherein:

said first switch is a normally open switch and said second switch is a normally closed switch.

12. A switch actuation mechanism, comprising:

a support structure;

a first switch attached to said support structure, said first switch having a first actuating plunger;

a first pivotable member rotatably attached to said support structure and movable between a first rest position and a first actuating position, said first pivotable member having a first actuating surface which is movable into force transmitting contact with said first actuating plunger to actuate said first switch when said first pivotable member is in said first rest position, said first pivotable member having a first protrusion;

a first resilient member disposed in contact with said first pivotable member to urge said first pivotable member to said first rest position, said first pivotable member being movable into said first actuating position to deactuate said first switch in response to movement of a first actuator into contact with said first protrusion;

a second switch attached to said support structure, said second switch having a second actuating plunger;

a second pivotable member rotatably attached to said support structure and movable between a second rest position and a second actuating position, said second pivotable member having a second actuating surface which is movable into force transmitting contact with said second actuating plunger to actuate said second switch when said second pivotable member is in said second rest position, said second pivotable member having a second protrusion; and a second resilient member disposed in contact with said second pivotable member to urge said second pivotable member to said second rest position, said second pivotable member being movable into said second actuating position to deactuate said second switch in response to movement of a second actuator into contact with said second protrusion.

13. The mechanism of claim 12, wherein:

said support structure is rigidly attached to a stationary structure.

14. The mechanism of claim 13, wherein:

said first and second actuators are rigidly attached to a movable structure, said movable structure being movable relative to said stationary structure, said first and second actuators being movable into contact with said first and second protrusions, respectively, in response to movement of said movable structure toward said stationary structure.

15. The mechanism of claim 14, wherein:

said second actuator is pivotable relative to said movable structure.

16. The mechanism of claim 15, wherein:

said stationary structure is a microwave oven and said movable structure is a door of said microwave oven.

17. The mechanism of claim 12, wherein:

said first switch is a normally open switch and said second switch is a normally closed switch.

* * * * *